US008246115B1

(12) United States Patent
Loyer et al.

(10) Patent No.: US 8,246,115 B1
(45) Date of Patent: Aug. 21, 2012

(54) INFANT CHAIR WITH ANIMAL MOTIF

(76) Inventors: Lina Loyer, Orleans (CA); Patrick Loyer, Orleans (CA)

( * ) Notice: Subject to any disclaimer, the term of this patent is extended or adjusted under 35 U.S.C. 154(b) by 181 days.

(21) Appl. No.: 12/790,256

(22) Filed: May 28, 2010

Related U.S. Application Data

(60) Provisional application No. 61/217,119, filed on May 28, 2009.

(51) Int. Cl.

| | |
|---|---|
| ***A47D 1/10*** | (2006.01) |
| ***A47D 13/08*** | (2006.01) |
| ***A47D 13/10*** | (2006.01) |
| ***A63G 9/10*** | (2006.01) |
| ***A63G 9/16*** | (2006.01) |

(52) U.S. Cl. ..... 297/253; 297/181; 297/250.1; 297/254; 297/255; 297/256; 297/256.1; 297/256.11; 297/256.15; 297/274; 297/275

(58) Field of Classification Search ..... 297/16.1, 297/181, 250.1, 254, 255, 256, 256.1, 256.13, 297/256.15, 256.16, 274, 275, 253, 256.11, 297/440.24

See application file for complete search history.

(56) References Cited

U.S. PATENT DOCUMENTS

| | | | | | |
|---|---|---|---|---|---|
| 442,629 | A | * | 12/1890 | Lipscomb | 297/188.06 X |
| 1,584,161 | A | * | 5/1926 | Bear | 297/254 |
| 1,680,794 | A | * | 8/1928 | Lawler | 297/254 |
| 2,428,088 | A | * | 9/1947 | McEachern | 297/254 |
| 2,481,382 | A | * | 9/1949 | Bennett | 297/254 X |
| 2,530,900 | A | * | 11/1950 | Nelson, Jr | 297/254 |
| 2,714,417 | A | * | 8/1955 | Golding | 297/254 X |
| 2,799,322 | A | * | 7/1957 | Jordan | 297/254 |
| 2,803,468 | A | * | 8/1957 | Thompson | 297/254 X |
| 2,848,036 | A | * | 8/1958 | Campbell | 297/254 X |
| 2,851,084 | A | * | 9/1958 | Benjetsky | 297/254 |
| 3,023,047 | A | * | 2/1962 | Linden | 297/254 |
| 3,062,583 | A | * | 11/1962 | Hamilton | 297/254 X |
| 3,094,356 | A | * | 6/1963 | Burke | 297/254 |
| 3,107,942 | A | * | 10/1963 | Rivkin | 297/254 |
| 3,115,364 | A | * | 12/1963 | Berlin | 297/250.1 X |
| 3,116,069 | A | * | 12/1963 | Dostal | 297/254 X |
| 3,144,273 | A | * | 8/1964 | Blackburn et al. | 297/254 |
| 3,146,026 | A | * | 8/1964 | Berlin | 297/255 |
| 3,157,432 | A | * | 11/1964 | Watkins | 297/254 |

(Continued)

FOREIGN PATENT DOCUMENTS

| | | | | |
|---|---|---|---|---|
| DE | 3304443 | A1 * | 8/1984 | 297/16.1 |

(Continued)

*Primary Examiner* — Rodney B White

(74) *Attorney, Agent, or Firm* — Montgomery Patent & Design, LLC; Robert C. Montgomery; Joseph Yaksich

(57) ABSTRACT

An infant chair designed to attach and secure to the rear of a seat functions as a conventional baby seat and has a soft fabric-based seat. The chair comprises a pair of adjustable handles that extend over the seating surface. The base of the chair also comprises a pair of adjustable legs to support the seat against the back cushion portion of the seat. The handles allow the infant chair to be placed upon a seat more safely than existing models. To make the chair more appealing to the infant, the chair comprises an animal motif with the handles being the upper arms of an animal and the lower base supports being the legs of an animal. The chair further has an integral vibrating mechanism and permanently attached toys to help amuse the infant while in the chair.

19 Claims, 10 Drawing Sheets

U.S. PATENT DOCUMENTS

D200,849 S * 4/1965 Weeden ..... 297/254 X
3,190,692 A * 6/1965 Collier ..... 297/254 X
3,207,528 A * 9/1965 Hasche ..... 297/254 X
3,222,104 A * 12/1965 Remington et al. ..... 297/254 X
3,245,717 A * 4/1966 Levy ..... 297/254
3,253,860 A * 5/1966 Shapiro ..... 297/254 X
3,272,553 A * 9/1966 Burns ..... 297/254
3,285,655 A * 11/1966 Silenius et al. ..... 297/254
3,400,976 A * 9/1968 Messier ..... 297/254 X
3,549,164 A * 12/1970 Raynor ..... 297/254 X
3,572,827 A * 3/1971 Merelis et al. ..... 297/256 X
3,583,761 A * 6/1971 Hume et al. ..... 297/256 X
3,632,165 A * 1/1972 Miller ..... 297/254
3,645,548 A * 2/1972 Briner ..... 297/254 X
3,669,492 A * 6/1972 Peterson ..... 297/256 X
3,690,525 A * 9/1972 Koons et al. ..... 297/255 X
3,829,113 A * 8/1974 Epelbaum ..... 297/254 X
3,934,934 A * 1/1976 Farrell et al. ..... 297/254 X
4,215,900 A * 8/1980 Coult ..... 297/254
4,553,786 A 11/1985 Lockett, III et al.
4,627,588 A * 12/1986 Block ..... 248/163.2
4,647,054 A * 3/1987 Chong ..... 297/254 X
4,695,092 A * 9/1987 Hittie ..... 297/181 X
4,700,988 A * 10/1987 Meyers ..... 297/254
4,718,715 A * 1/1988 Ho ..... 297/256.13 X
4,722,713 A * 2/1988 Williams et al. ..... 446/227
4,759,588 A * 7/1988 Husnik ..... 297/181 X
4,865,380 A * 9/1989 Heitzman-Powell et al. 297/255 X
D314,870 S * 2/1991 Walsh ..... D6/358
5,076,520 A * 12/1991 Bro ..... 248/165
5,147,109 A * 9/1992 Jolly ..... 297/181 X
5,222,641 A * 6/1993 Medeiros, Jr. ..... 297/255 X
5,228,746 A 7/1993 Burleigh
5,265,931 A * 11/1993 Ryan ..... 297/250.1 X
5,317,765 A * 6/1994 Knoedler et al. ..... 4/572.1
D362,346 S * 9/1995 Clarke ..... D6/333
5,478,268 A * 12/1995 Au ..... 446/227
5,528,785 A 6/1996 Petrus
5,556,162 A * 9/1996 Raffini ..... 297/256.15
5,560,680 A * 10/1996 Salvador et al. ..... 297/256.15
5,575,530 A 11/1996 Harper et al.
5,652,975 A * 8/1997 Hoskin ..... 4/661
5,702,039 A * 12/1997 Olaiz ..... 224/409
5,749,599 A * 5/1998 Gardner ..... 297/256.15 X
5,836,649 A * 11/1998 Bonetti ..... 297/256.1
5,868,465 A 2/1999 Kvalvik
5,895,092 A * 4/1999 Fischer ..... 297/256.15
D411,771 S * 7/1999 Ellingwood ..... D6/358
5,928,054 A * 7/1999 Mast ..... 446/227
5,941,599 A * 8/1999 Roberts ..... 297/181 X
6,203,395 B1 * 3/2001 McElhaney ..... 446/227
6,309,016 B1 * 10/2001 Aloisi ..... 297/181
6,386,639 B1 * 5/2002 McMichael ..... 297/250.1 X
6,409,271 B1 * 6/2002 Caramanis ..... 297/181 X
D461,854 S * 8/2002 Myers ..... D21/476
6,431,646 B1 8/2002 Longoria
6,540,292 B2 4/2003 Darling et al.
6,592,425 B2 * 7/2003 Bapst et al. ..... 446/227
6,629,727 B2 * 10/2003 Asbach et al. ..... 297/188.21
6,860,786 B2 * 3/2005 Oren et al. ..... 446/227
7,530,634 B1 * 5/2009 Mortazavi et al. ..... 297/181 X
RE41,121 E * 2/2010 Asbach et al. ..... 297/188.21
7,661,636 B1 * 2/2010 Burke ..... 248/102
7,785,167 B2 * 8/2010 Friend-Douglass ..... 297/181 X
7,854,476 B1 * 12/2010 Liu ..... 297/181
7,942,478 B2 * 5/2011 Cymbalski et al. ..... 297/250.1
8,007,043 B1 * 8/2011 Vuong ..... 297/250.1
2001/0035671 A1 * 11/2001 Brooks ..... 297/181 X
2003/0201662 A1 * 10/2003 Armbruster et al. ..... 297/274 X
2005/0268377 A1 * 12/2005 Massey ..... 2/209.13

FOREIGN PATENT DOCUMENTS

EP 228158 A2 * 7/1987 ..... 297/250.1
GB 2165443 A * 4/1986 ..... 297/250.1
WO WO 8901422 A1 * 2/1989 ..... 297/250.1

* cited by examiner

55b

INFANT CHAIR WITH ANIMAL MOTIF

RELATED APPLICATIONS

The present invention was first described in and claims the benefit of U.S. Provisional Application No. 61/217,119 filed May 28, 2009, the entire disclosures of which are incorporated herein by reference.

FIELD OF THE INVENTION

The present invention relates generally to infant chairs, and in particular, to an infant chair adapted for use with furniture such as couches with provisions for selectively interchangeable decorative facades.

BACKGROUND OF THE INVENTION

Infants are delicate little beings that require the utmost care in order protect and keep them safe from harm. As a result, there are a myriad of products intended to provide protection from the danger generated by a variety of sources. Perhaps one (1) of the most common items for infant caretaking is that of the baby seat. Such seats aid in the secure transportation and safe seating of infants.

Such seats are often placed on a floor surface for safety. However, this requires the user to bend over to pick up the infant. Also, use of such seats in other locations or positions often results in negation of many of the safety features of the device and can result in dangerous results such as the infant falling over, or the like. Failure to use these devices can result in diminished protection, support, and comfort for an infant during sitting and transportation.

Various attempts have been made to provide infant chairs adaptable for use with furniture and the like. Examples of these attempts can be seen by reference to several U.S. patents. U.S. Pat. No. 5,228,746, issued in the name of Burleigh, describes a child safety seat adapted for use in motor vehicles. The Burleigh seat includes a base which rests on a motor vehicle seat and secures via an existing adult lap belt.

U.S. Pat. No. 5,528,785, issued in the name of Petrus, describes an attachable couch-cushion confining device for infants. The Petrus device converts a couch cushion into a confining device for a baby via a wedge portion along a perimeter edge.

U.S. Pat. No. 5,868,465, issued in the name of Kvalvik, describes a child's seating restraint which provides a means for inserting into a crack in a couch or the like for anchoring of a child seating device.

While these devices fulfill their respective, particular objectives, each of these references suffer from one (1) or more of the aforementioned disadvantages. Many such devices are not usable in a number of desirable locations or positions. Also, many such devices are not easy and quick to setup and remove without undue manipulation. Furthermore, many such devices are not adjustable and adaptable to various configurations. In addition, many such devices are not safe when utilized in conjunction with furniture such as couches and the like. Accordingly, there exists a need for an infant chair without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for an infant chair which can be safely used in conventional location in addition to being safely adapted for use with couches and the like in a manner which is simple, quick, and adjustable. Thus, the object of the present invention is to solve the aforementioned disadvantages and provide for this need.

To achieve the above objectives, it is an object of the present invention to comprise an infant chair with an animal motif which provides a means for securing, soothing, and transporting an infant in a seated position. The apparatus comprises a frame, a seat, a toy bar, a plurality of motif correlated animal portions, and associated electrical components.

Another object of the present invention is to provide features of a conventional baby "bouncy" seat such as use on a level ground surface or the like in a common manner.

Yet still another object of the present invention is to provide an area to support a sitting or partially laying infant in a secure manner via an adjustable harness.

Yet still another object of the present invention is to attach to a couch and similar pieces of furniture in a secure manner which allows a caregiver to easily and quickly lift the infant when necessary. This is accomplished via a pair of handles which suspend the apparatus from a couch back portion.

Yet still another object of the present invention is to comprise enhanced aesthetic feature such as the appearance of a monkey which visually stimulate an infant or the like.

Yet still another object of the present invention is to provide entertainment to an infant via a toy bar which allows a user to selectively attach and suspend a plurality of toys of various plush shapes, colors, patterns, and the like.

Yet still another object of the present invention is to provide removable attachment of a plurality of decorative and comfortable aesthetic portions such as a monkey head, monkey leg covers, monkey arm covers, and the like. A user may selectively remove and reattached these portions via a plurality of fastening means to allow for replacement, washing, and the like.

Yet still another object of the present invention is to allow for horizontal adjustment and securement of the apparatus against a couch back portion via adjustable legs which engage an internal portion of the frame via a common spring-loaded adjustment means.

Yet still another object of the present invention is to allow the apparatus to rotate to a desired position via a rotatable ground support.

Yet still another object of the present invention is to allow for adjustment of the hanging handles to vary the overall height of the apparatus necessary for varying heights of couches or other similar structures. The handles engage an internal portion of the frame via a common spring-loaded adjustment means.

Yet still another object of the present invention is to provide electrical vibration functions to soothe an infant. The apparatus includes an internal battery powering means and various controls which allow the vibrating means to be manually actuated and adjusted.

Yet still another object of the present invention is to provide a method of utilizing the device that provides a unique means of providing the apparatus with a desired aesthetic appearance, providing the apparatus with a desired plurality of toys and entertainment devices, placing the apparatus in a desired location along a ground surface or piece of furniture, selectively rotating the apparatus, selectively adjusting the height of the handles for hanging from a furniture back portion, selectively adjusting the horizontal legs for secure placement of the apparatus on a piece of furniture, and easily lifting and carrying the apparatus from its secure position on a piece of furniture for transport or the like.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
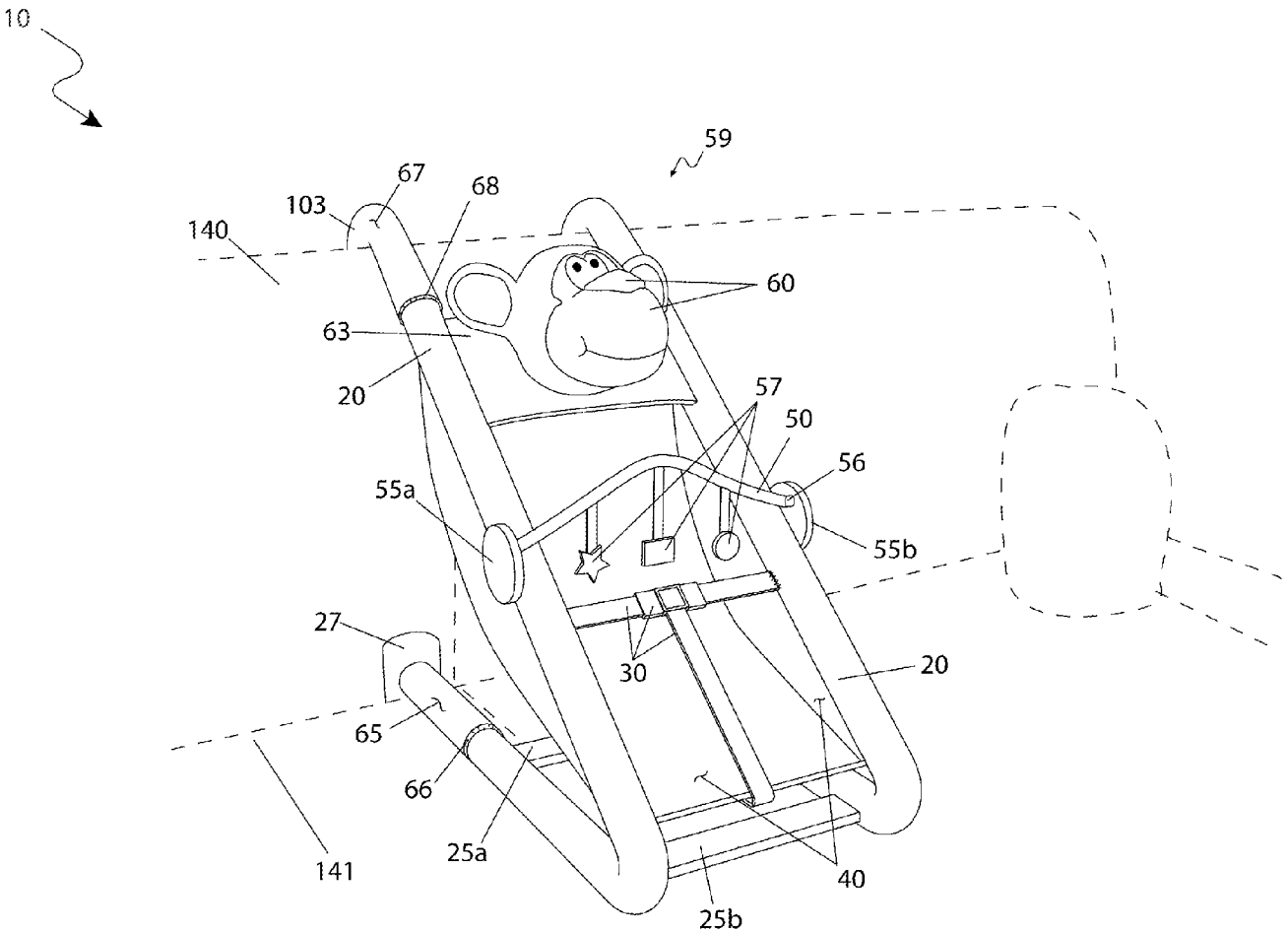
FIG. 1 is an environmental perspective view of an infant chair with animal motif 10 depicting placement on a couch, according to a preferred embodiment of the present invention.

| | |
|---|---|
| 10 | infant chair with animal motif |
| 20 | frame |
| 21 | slot |
| 25a | rear support brace |
| 25b | front support brace |
| 27 | ground support |
| 28 | groove |
| 30 | harness |

-continued

| | |
|---|---|
| 40 | seat |
| 50 | toy bar |
| 55a | first toy bar attachment |
| 55b | second toy bar attachment |
| 55c | internal portion |
| 56 | protrusion |
| 57 | toy |
| 59 | monkey motif |
| 60 | monkey head |
| 61 | head attachment portion loop fastener |
| 63 | head attachment portion |
| 64 | head attachment portion hook fastener |
| 65 | monkey leg cover |
| 66 | leg cover elastic portion |
| 67 | monkey arm cover |
| 68 | arm cover elastic portion |
| 70 | battery compartment |
| 75 | battery |
| 80 | power switch |
| 81 | operational switch |
| 88 | leg |
| 89 | leg groove |
| 90 | length adjustment aperture |
| 95 | length adjustment pin |
| 103 | handle |
| 104 | handle flattened portion |
| 105 | handle adjustment aperture |
| 107 | handle adjustment pin |
| 108 | handle groove |
| 120 | motor |
| 121 | ear |
| 122 | shaft |
| 123 | offset mass |
| 130 | electrical wiring |
| 140 | back portion |
| 141 | seat portion |
| 150 | elephant motif |
| 152 | elephant head |
| 154 | bear motif |
| 156 | bear head |
| 158 | frog motif |
| 160 | frog head |

DETAILED DESCRIPTION OF THE PREFERRED EMBODIMENT

The best mode for carrying out the invention is presented in terms of its preferred embodiment, herein depicted within FIGS. 1 through 10 and alternately, herein depicted within FIGS. 11*a* through 13*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an infant chair with animal motif (herein described as the "apparatus") 10, which provides a means for securing, soothing, and transporting an infant while positioned in a seated position. The apparatus 10 comprises a frame 20, a seat 40, a toy bar 50, a plurality of motif correlated animal portions 59, 150, 154, 158, and associated electrical and electronic components. The apparatus 10 is utilized as a common baby "bouncy" seat or may be attached to a couch or similar piece of furniture to secure the infant out of harms way and allow a caregiver to easily lift said infant when necessary.

Figure 2:
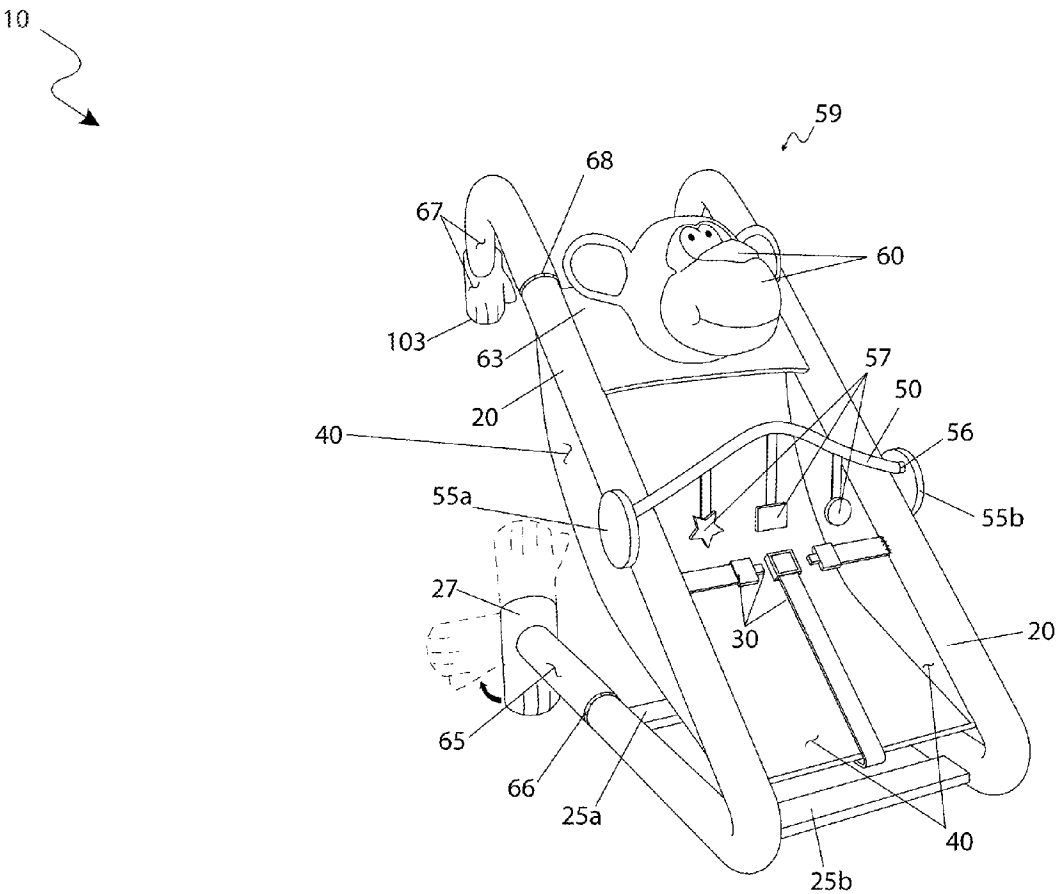
FIG. 2 is a perspective view of the infant chair with animal motif 10, according to a preferred embodiment of the present invention.

Referring now to FIG. 1 an environmental perspective view of the apparatus 10 depicting placement on a couch and FIG. 2, a perspective view of the apparatus 10, according to the preferred embodiment of the present invention, are disclosed. The apparatus 10 comprises a resilient frame 20 similar to the common baby seats. The frame 20 comprises a pair of inclined members which angle upwardly and extend horizontally and rearwardly to engage a ground surface. The frame 20 enables placement of a seat 40, a toy bar 50, a pair of adjustable legs 88, and a pair of adjustable handles 103. The preferred embodiment of the apparatus 10 comprises a monkey motif 59 further comprising enhanced monkey features which visually stimulate the aesthetics of the apparatus 10. The apparatus 10 comprises a monkey head 60, a pair of removably attachable monkey leg covers 65, and a pair of removably attachable monkey arm covers 67. In use, the apparatus 10 is preferably suspended from a couch back portion 140 via a pair of handles 103 which enables said apparatus 10 to also rest on top of a couch seat portion 141 and provides a means to maintain the security of the infant. The apparatus 10 may also be positioned on a level surface in a common manner.

Figure 3:
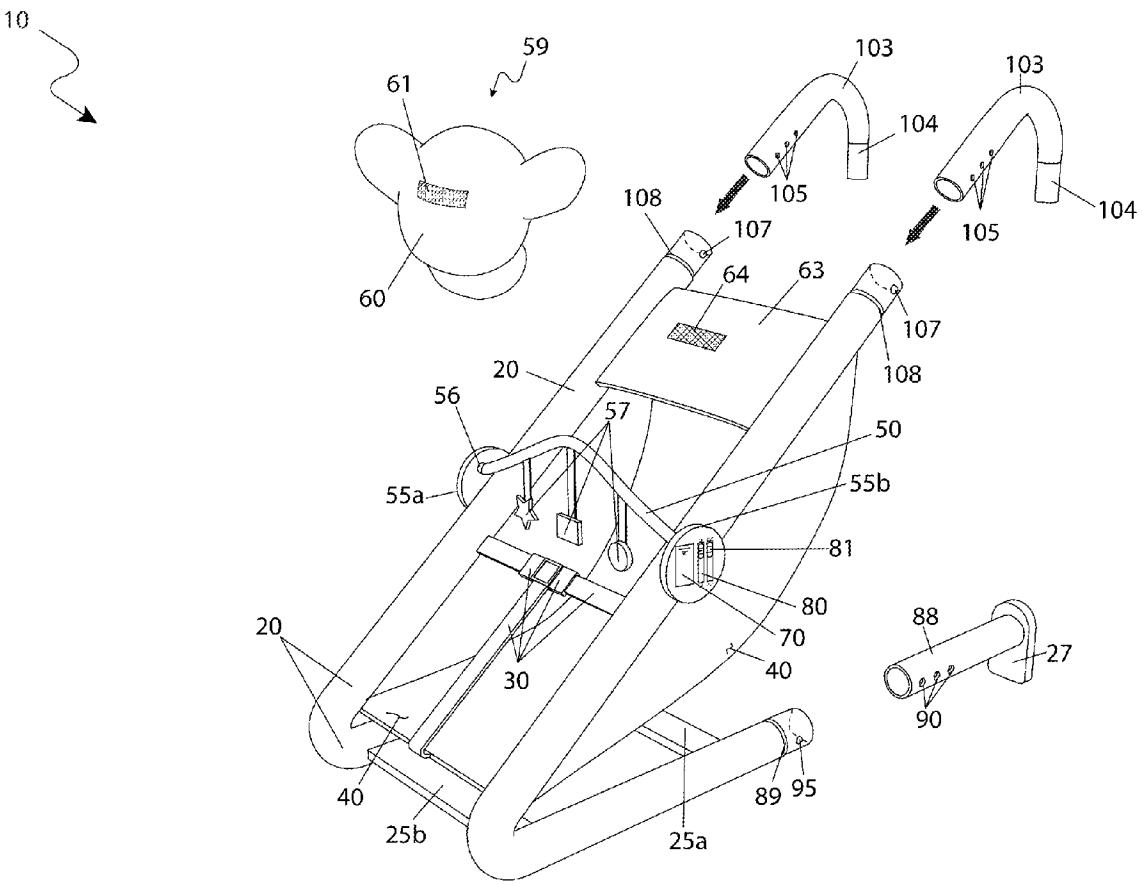
FIG. 3 is an exploded perspective view of the infant chair with animal motif 10, according to a preferred embodiment of the present invention.
Figure 4:
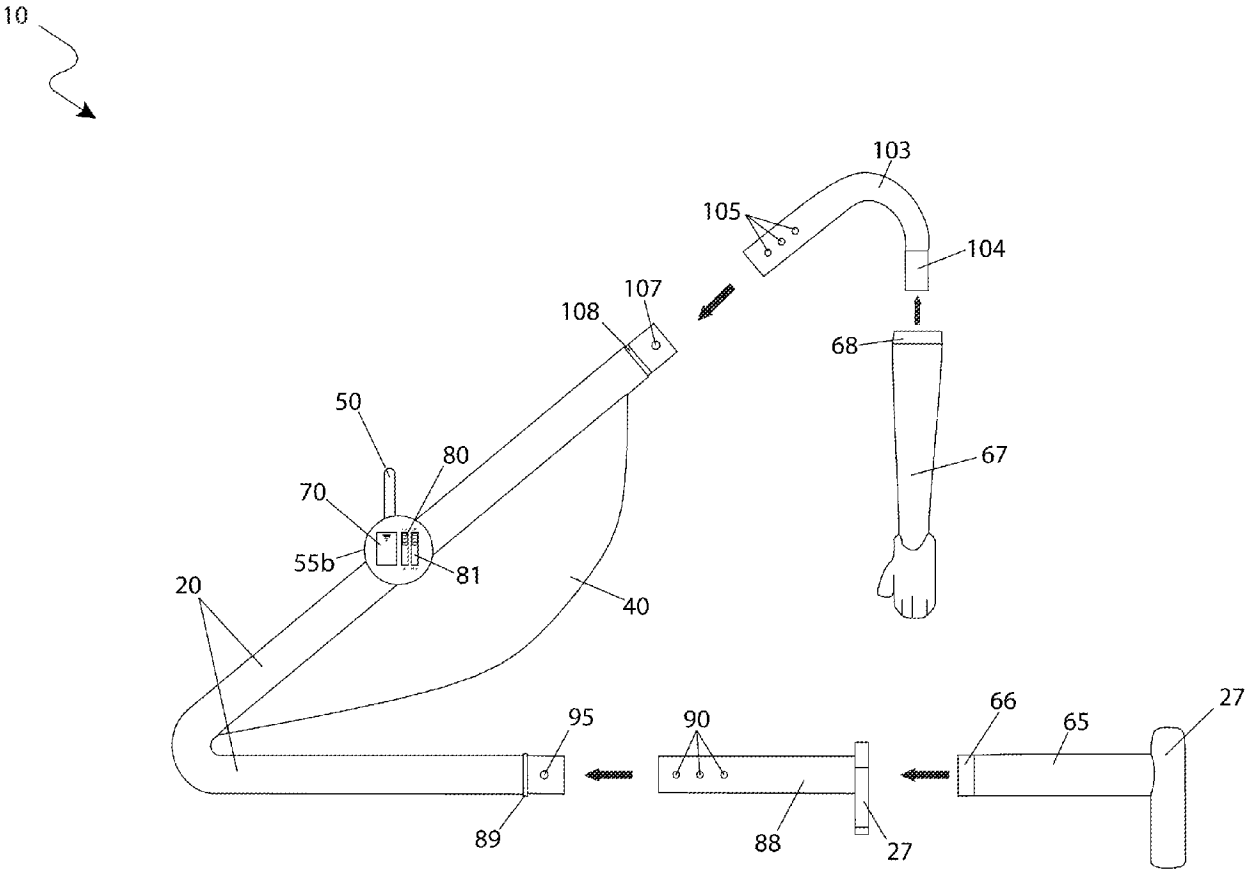
FIG. 4 is an exploded side view of the infant chair with animal motif 10, according to a preferred embodiment of the present invention.
Figure 5:
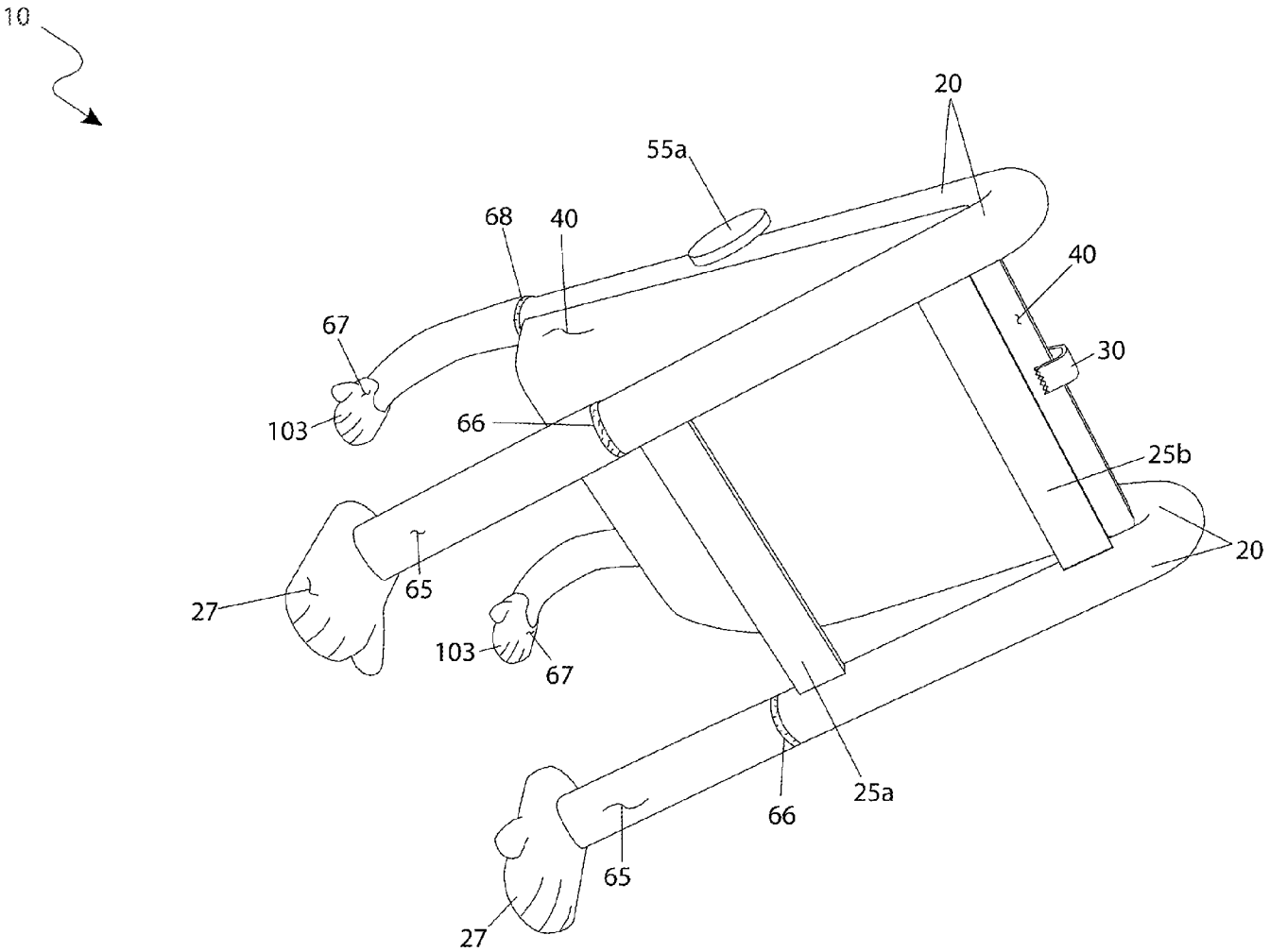
FIG. 5 is an underside perspective view of the infant chair with animal motif 10, according to a preferred embodiment of the present invention.
Figure 6:
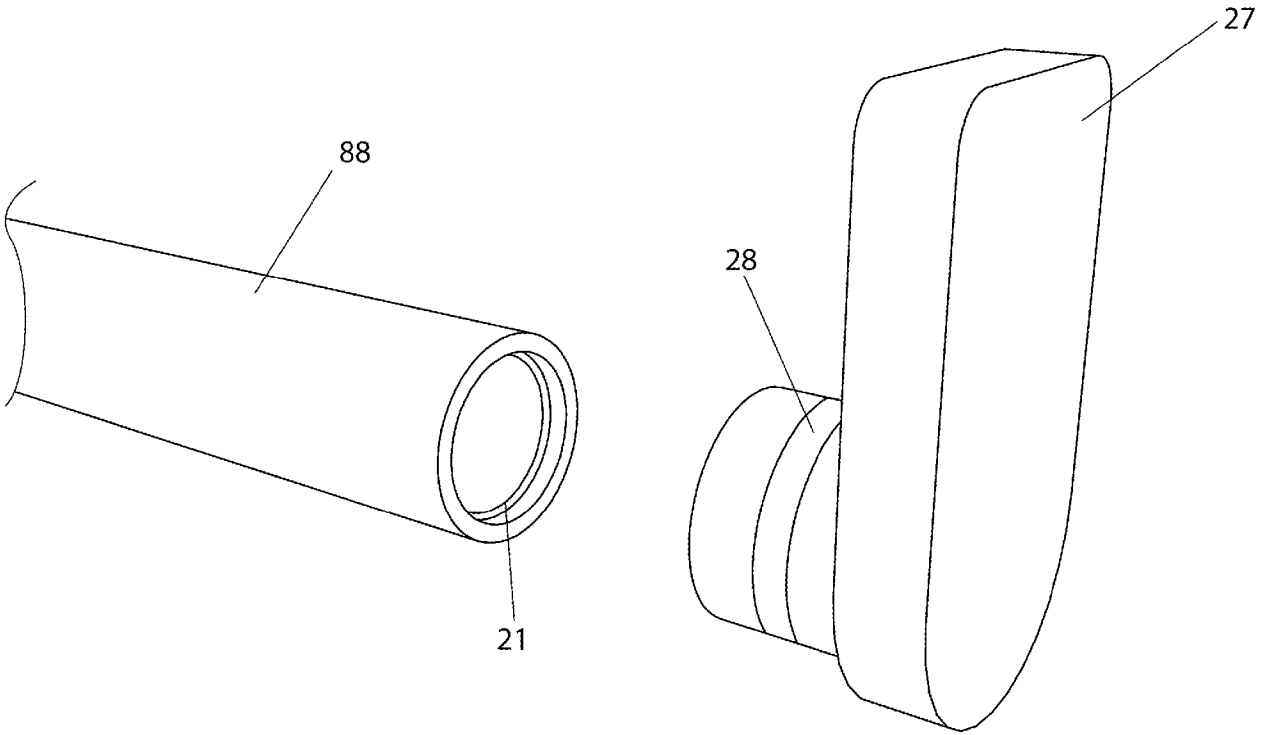
FIG. 6 is a close-up perspective view of a ground support 27, according to a preferred embodiment of the present invention.

Referring now to FIG. 3 through FIG. 6, various views of the apparatus 10, according to the preferred embodiment of the present invention, are disclosed. FIG. 3 depicts an exploded perspective view of the apparatus 10, FIG. 4 depicts an exploded side view of the apparatus 10, FIG. 5 depicts an underside perspective view of the apparatus 10, and FIG. 6 depicts a close-up perspective view of a ground support 27. As above-mentioned, the apparatus 10 comprises a pair of inclined frames 20 which are preferably fabricated from a lightweight material such as, but not limited to: metal wire, tubular metal, or heavy gauge plastic. The frames 20 are structurally supported and separated at a desired width via a rear support brace 25*a* and a front support brace 25*b*. The braces 25*a*, 25*b* are comprised of rectangular member's integrally molded and positioned perpendicular to a horizontal portion of the frames 20.

The frames 20 also comprise a seat 40 which provides an area to support a sitting or partially laying infant. The seat 40 is comprised of a durable washable material such as, but not limited to: plastic coated fabrics, meshed vinyls, or the like. The seat 40 is permanently attached and supported to the inclined portions of the frames 20 via conventional sewing techniques or the like. The seat 40 comprises an adjustable harness 30 which secures and protects an infant 110 within said seat 40. The harness 30 comprises a buckling means and preferably a three-point strapping system. The harness 30 extends from the bottom of the seat 40 relative to a leg portion on the infant to a central position relative to a waist portion on said infant. The harness 30 is fabricated from materials such as nylon, yet other materials may be utilized without limiting the scope of the apparatus 10 and is attached to the seat 40 and inclined portions of the frames 20 via conventional sewing techniques.

Also attached to an intermediate portion of each inclined portion the frame 20 is a first toy bar attachment 55*a* and a second toy bar attachment 55*b* which provide an attachment means to a toy bar 50 and a plurality of toys 57. Each toy bar attachment 55*a*, 55*b* is integrally molded to the frames 20 and comprises a cylindrical form. An inner surface of each toy bar attachment 55*a*, 55*b* also comprises a protrusion 56 which enables each said toy bar attachment 55*a*, 55*b* to engage a toy bar 50. The toy bar 50 comprises an arcuate form comprised of a tubular wire or plastic which provides a means to suspend the plurality of toys 57. The toy bar 50 is removable attached from one (1) toy bar attachment 55*a*, 55*b* to the other via insertably engaging each protrusion 56 with end portions of said toy bar 50 (see FIG. 7). A variety of toys 57 which are comprised of various plush shapes and a variety of colors and patterns are attached to the toy bar 50 to provide entertainment to the infant. The toys 57 are attached with fastening means such as, but not limited to: hook-and-loop fasteners, sewing techniques, or the like. The toy bar attachments 55*a*, 55*b* are preferably fabricated from a plastic material, yet other materials may be incorporated.

The second toy bar attachment 55*b* is depicted herein as comprising a battery compartment 70, a power switch 80, and an operational switch 81 for illustration purposes only; it is known that other positions such as the first toy bar attachment 55*a* may be utilized without limiting the scope of the apparatus 10. The battery compartment 70 and switches 80, 81 provide an operating and controlling means to a vibrating feature of the apparatus 10 (see FIGS. 8 though 10).

The frame 20 further comprises a monkey head 60 for illustration purposes only and it is known that other animals (see FIGS. 11*a* through 11*b*) may be utilized without limiting the scope of the apparatus 10. The monkey head 60 is stuffed similar to that of stuffed animals or teddy bears and is fabricated from a plush mohair fabric, yet other materials may be incorporated without limiting the scope of the apparatus 10. The monkey head 60 is removably attachable from a head attachment portion 63 which is located and attached to an upper portion of the seat 40 via conventional sewing techniques. The head attachment portion 63 is preferably fabricated from a similar material as the seat 40 and comprises a head attachment portion hook fastener 64 which engages a head attachment portion loop fastener 61 to attach the monkey head 60 to said head attachment portion 63. The head attachment portion loop fastener 61 is located on a rear intermediate surface of the monkey head 60 and the head attachment portion hook fastener 64 is located on an upper intermediate surface of the head attachment portion 63.

The frame 20 further comprises a pair of adjustable legs 88 which provide varied horizontal positions for the apparatus 10 and provides a means to secure the apparatus between the couch back portion 140 and couch seat portion 141 (see FIG. 1). The legs 88 are comprised of tubular members that engage a lower portion of each frame 20. The legs 88 vary the overall length of the apparatus 10 necessary for varying depths of couches or other structures. The legs 88 engage an internal portion of the frame 20 and are adjusted via a common spring-loaded adjustment means further comprising a plurality of length adjustment apertures 90 equidistantly spaced along a distal surface of said legs 88. The length adjustment apertures 90 are selectively engaged by a length adjustment pin 95 which is located on the lower surface of the frames 20. The legs 88 are fabricated from an identical material as the frame 20.

The legs 88 also comprise a rotatable ground support 27 (see FIG. 2) which enables the apparatus 10 to engage an area between the couch back portion 140 and couch seat portion 141 (see FIG. 1). The ground support 27 takes on an "L"-shaped form comprising similar features to an animal's foot. An outer circumference of the ground support 27 comprises a groove 28 which is friction fitted to a slot 21 located along an internal circumference of the horizontal portion of the frames 20. The groove 28 engages the slot 21 and enables the ground support 27 to rotate to a desired position. In use, if the apparatus 10 is positioned on a couch the ground support 27 is positioned downwardly, thereby enabling said ground support 27 to engage the area between the couch back portions 140 and couch seat portion 141. In use, if the apparatus 10 is positioned on a level surface each ground support 27 is positioned upwardly to provide stability to said apparatus 10.

The legs 88 also provide an attachment means to a pair of removable attachable monkey leg covers 65. The monkey leg covers 65 provide additional animal motif features which are removably attachable to enable the apparatus 10 to be cleaned, disinfected, or for changing animal motifs as necessary. The monkey leg covers 65 are herein depicted as common monkey feet or paw features such as ankles, toes, or the like. The monkey leg covers 65 are fabricated from a plush mohair fabric, yet other materials may be incorporated. Distal end portions of each monkey leg cover 65 comprise a leg cover elastic portion 66 which provides an attachment means to each leg portion 88 and frame 20. The leg cover elastic portions 66 engage a leg groove 89 to secure the monkey leg covers 65 onto the leg portion 88 and frame 20. The leg groove 89 is located on a horizontal outer circumference of the frame 20 adjacent to each length adjustment pin 95. Each monkey leg cover 65 is positioned over each leg 88 via the slip-fitting means and each leg cover elastic portions 66 is positioned around each leg groove 89, thereby prohibiting said monkey leg covers 65 from becoming unfastened.

The frame 20 yet further comprises a pair of adjustable handles 103 which provide a means to suspend the apparatus 10 from a couch back portion 140 (see FIG. 1). The handles 103 are comprised of arcuate tubular members which engage an upper portion of each frame 20. The handles 103 also comprise an integrally molded handle flattened portion 104 on a proximal end which provides a flattened surface to engage a rear portion of the couch back portion 140 which further provides a secure and stable suspending of the apparatus 10. The handle portions 100 vary the overall height of the apparatus 10 necessary for varying heights of couches or other similar structures. The handles 103 engage an internal portion of the frame 20 are adjusted via a common spring-loaded adjustment means further comprising a plurality of handle adjustment apertures 105 equidistantly spaced along a distal surface of said handles 103. The handle adjustment apertures 105 are selectively engaged by a handle adjustment pin 107 which is located on the upper portion of the frames 20. The handles 103 are fabricated from an identical material as the frame 20.

The handles 103 also provide an attachment means to a pair of removable attachable monkey arm covers 67. The monkey arm covers 67 provide additional monkey motif features which are removably attachable to enable the apparatus 10 to be cleaned, disinfected, or for changing animal motifs as necessary. The monkey arm covers 67 are herein depicted comprise common animal hand or paw features such as palms, fingers, or the like. The monkey arms covers 67 are fabricated from a plush mohair fabric, yet other materials may be incorporated. Distal end portions of each monkey arm cover 67 comprise an arm cover elastic portion 68 which provides an attachment means to each handle 103 and each frame 20. The arm cover elastic portions 68 engage a handle groove 108 to secure the arm covers 67 onto the handles 103. The handle groove 108 is located on an upper portion of the frame 20 along an outer circumference which lies adjacent to each handle adjustment pin 107. Each monkey arm cover 67 is positioned over each handle 103 via the slip-fitting means and each arm cover elastic portions 68 is positioned around each handle groove 108, thereby prohibiting said monkey arm covers 67 from becoming unfastened.

Figure 8:
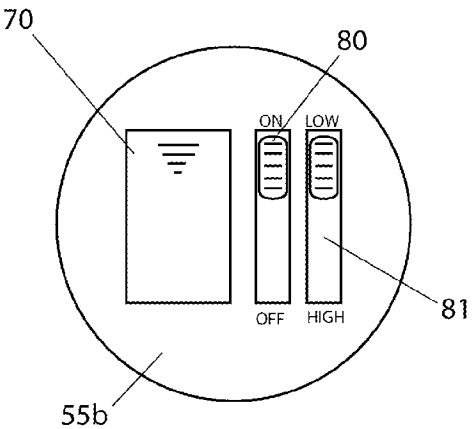
FIG. 8 is a front view of the toy bar attachment 55*b*, according to a preferred embodiment of the present invention.
Figure 7:
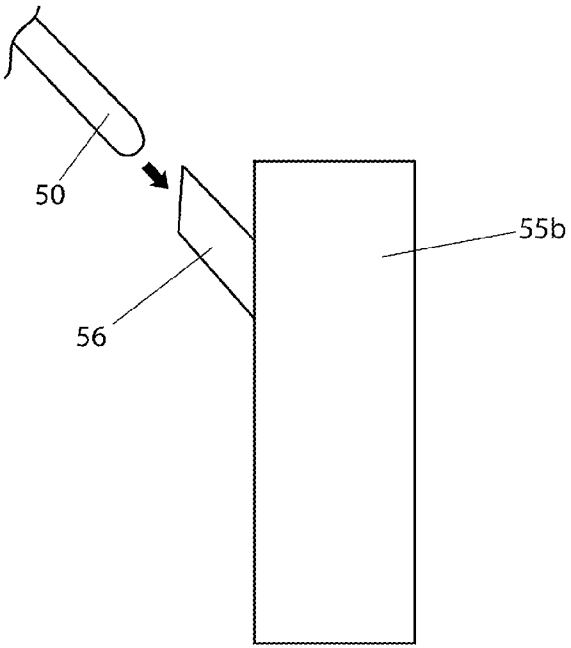
FIG. 7 is a side view of a toy bar 50 depicting an attachment to a second toy bar attachment 55*b*, according to a preferred embodiment of the present invention.
Figure 9:
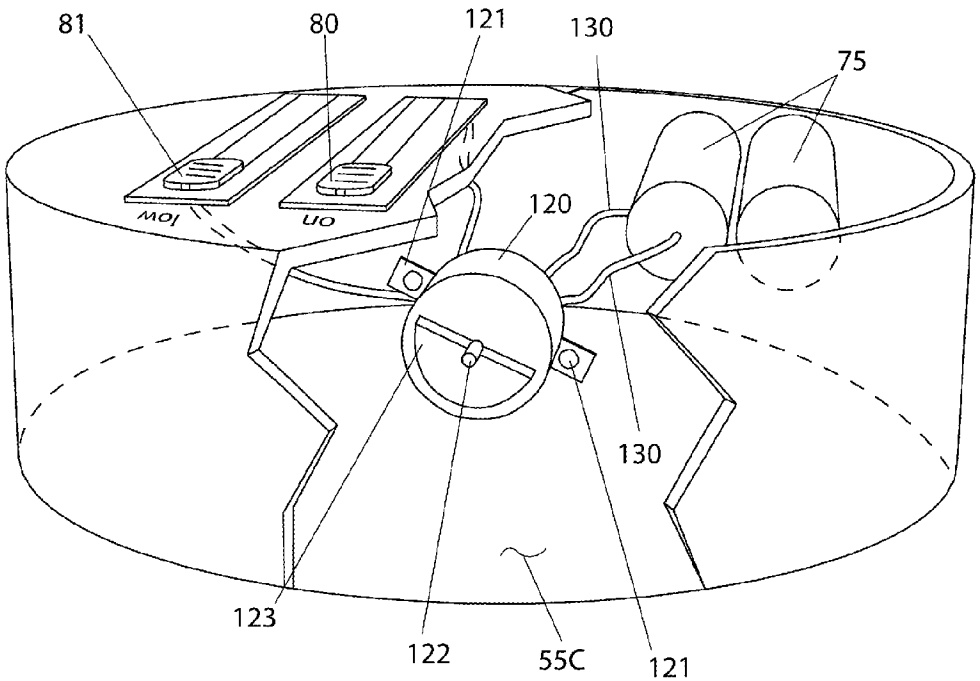
FIG. 9 is a perspective break-away view of the toy bar attachment 55*b*, according to a preferred embodiment of the present invention.
Figure 10:
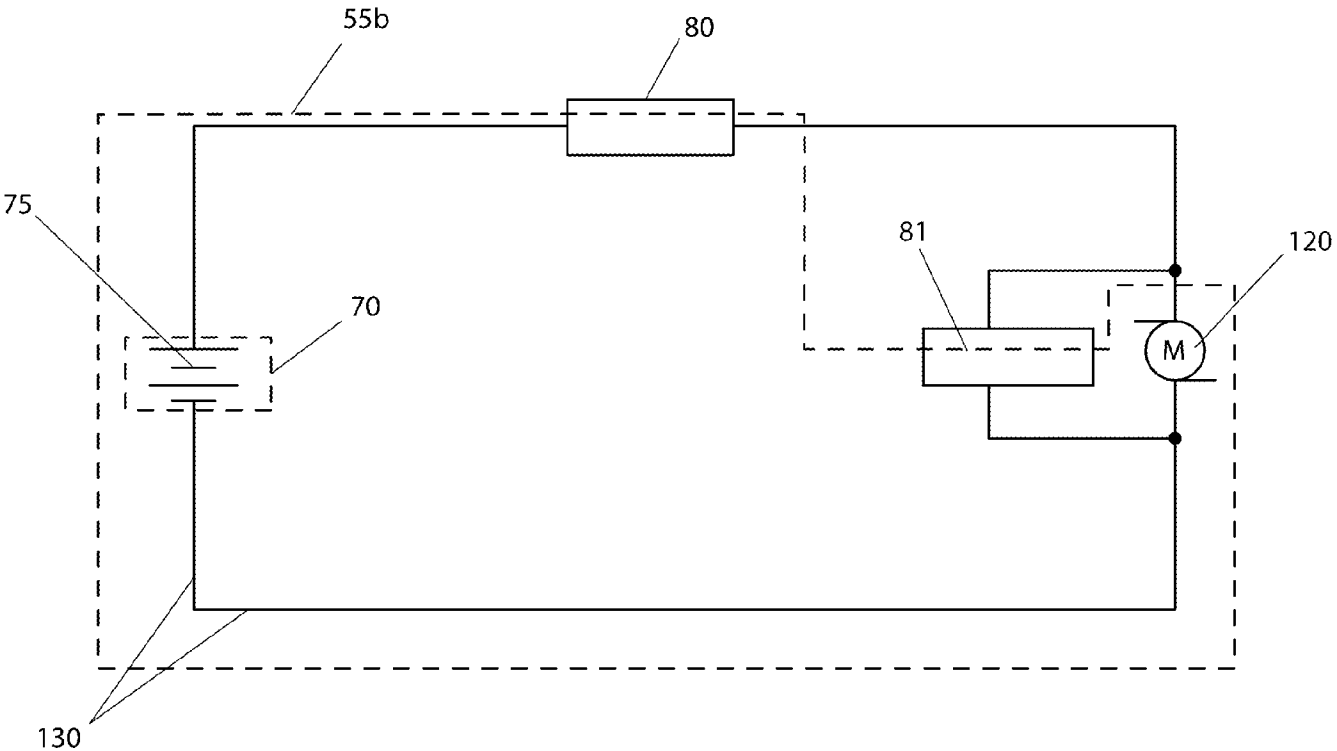
FIG. 10 is an electrical block diagram of the toy bar attachment 55*b*, according to a preferred embodiment of the present invention.

Referring now to FIG. 7 though FIG. 10, various views of the second toy bar attachment 55*b*, according to the preferred embodiment of the present invention, are disclosed. FIG. 7 depicts a side view of a toy bar 50 depicting an attachment to a second toy bar attachment 55*b*, FIG. 8 depicts is a front view of the toy bar attachment 55*b*, FIG. 9 depicts a perspective break-away view of the toy bar attachment 55*b*, and FIG. 10 depicts an electrical block diagram of the toy bar attachment 55*b*. The toy bar 50 is removably attachable to each toy bar attachment 55*a*, 55*b* via inserting a distal or proximal end portion, respectively, into a protrusion 56 which is located on an inner surface of each said toy bar attachment 55*a*, 55*b*. Other methods of attaching the toy bar 50 into each toy bar attachment 55*a*, 55*b* may be utilized without limiting the scope of the apparatus 10.

The apparatus 10 comprises a battery 75 housed within the battery compartment 70. The battery 75 is interconnected with electrical wiring 130 to a power switch 80, operational switch 81, and a motor 120 which provide a vibrating means to the apparatus 10. Although the electronic components are illustrated as being housed within the second toy bar attachment 55*b* it is known that other locations may be utilized to store said components without limiting the scope of the apparatus 10.

The power switch 80 enables the vibrating means to be manually activated or deactivated, thereby providing an ON and OFF function. The operational switch 81 controls the speed of the vibrating means which further increases or decreases the rotation of the motor shaft 122. The motor 120 is a common direct current (DC) motor 120 with an offset mass 123 which causes the second toy bar attachment 55*b* to vibrate. The vibration of the second toy bar attachment 55*b* travels along the toy bar 50 which enables the toys 57 to move and provides a soothing means to the infant. The offset mass 123 is attached to the shaft 122 via fastening means such as, but not limited to: integral molding, threading means, or the like. As the shaft 122 rotates the offset mass 123 rotates causing an unbalanced vibration. The motor 120 is attached to an internal portion 55*c* via mounting a pair of ears 121 with common fasteners. In use, an electrical current is sent through the electrical wiring 130 to the switches 80, 81 and motor 120, thereby providing the vibrating feature to the apparatus 10.

Figure 11A:
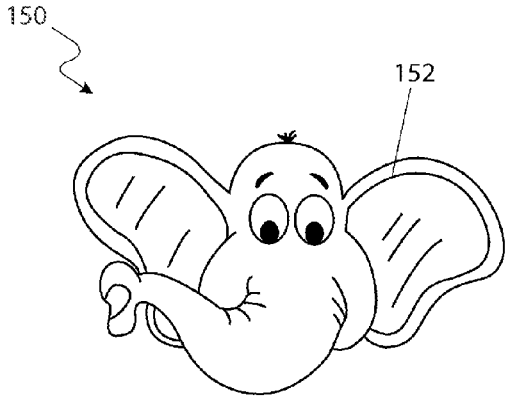
FIG. 11*a* is a front view of an elephant motif 150, according to a preferred embodiment of the present invention.
Figure 11B:
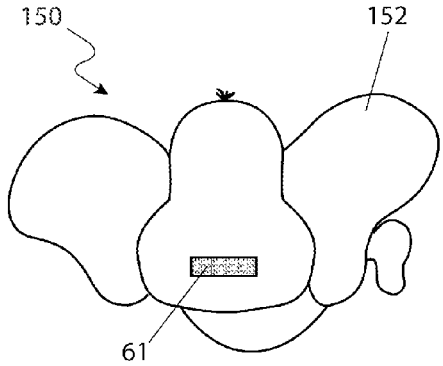
FIG. 11*b* is a rear view of the elephant motif 150, according to a preferred embodiment of the present invention.
Figure 12A:
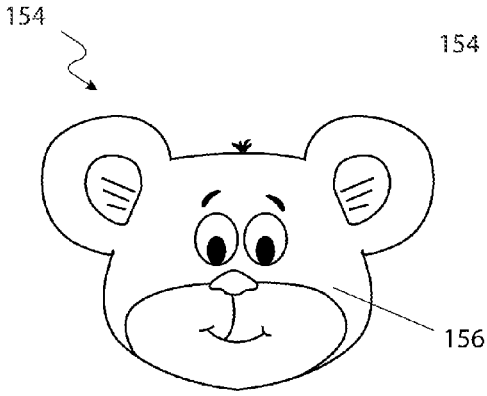
FIG. 12*a* is a front view of a bear motif 154, according to a preferred embodiment of the present invention.
Figure 12B:
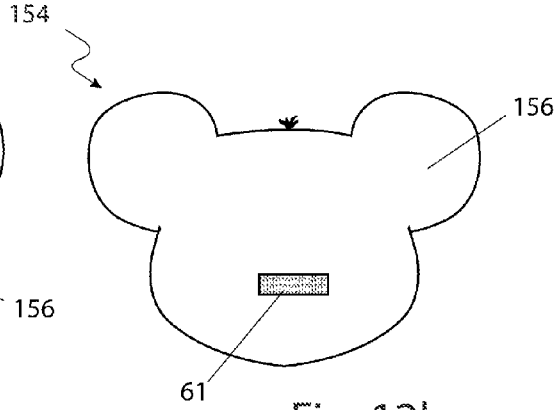
FIG. 12*b* is a rear view of the bear motif 154, according to a preferred embodiment of the present invention.
Figure 13A:
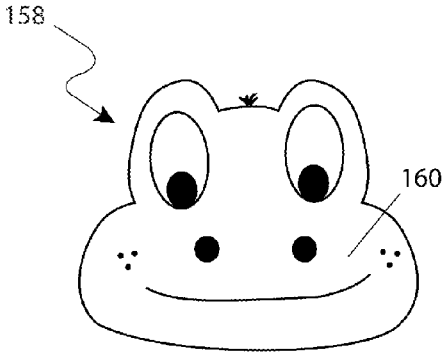
FIG. 13*a* is a front view of a frog motif 158, according to a preferred embodiment of the present invention; and, FIG. 13*b* is a rear view of the frog motif 158, according to a preferred embodiment of the present invention.
Figure 13B:
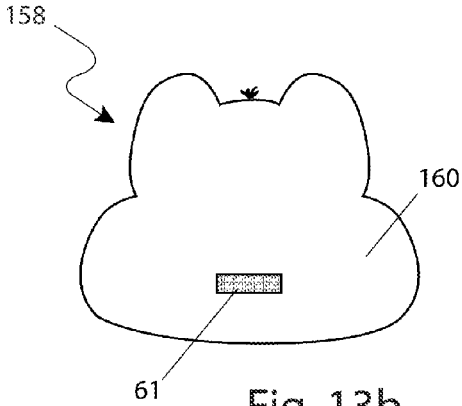

Referring now to FIG. 11*a* though FIG. 13*b*, views of alternate motifs, according to the preferred embodiment of the present invention, are disclosed. The apparatus 10 may comprise alternate animal motif embodiments 150, 154, 158 which preferably modify the design of the animal head 152, 156, 160 and colors utilized on the seat 40, monkey leg covers 65, and monkey arm covers 67. FIG. 11*a* depicts a front view of an elephant motif 150, FIG. 11*b* depicts is a front view of bear motif 154, and FIG. 11*c* depicts a front view of a frog motif 158. The elephant motif 150 comprises an elephant head 152 and various colors associated with common elephants such as grey. The bear motif 154 comprises a bear head 156 and various colors associated with common bears such as brown and black. The frog motif 158 comprises a frog head 160 and various colors associated with common frogs such as green. Each head 152, 156, 160 is fabricated similar to the monkey head 60 and comprises similar fastening means.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of utilizing the apparatus 10 may be achieved by performing the following steps: acquiring the apparatus 10; inserting an appropriate amount of batteries 75 within the battery compartment 70; removing the toy bar 50; attaching the desired head 60, 152, 156, 160 on the head attachment portion 63 via engaging the head attachment portion loop fastener 61 with the head attachment portion hook fastener 64 as desired; unbuckling the harness 30; adjusting the leg 88 to a desired position with the length adjustment apertures 90 and length adjustment pins 95; installing the monkey leg covers 65 onto each leg 88 and securing the leg cover elastic portion 66 over the leg groves 89; adjusting the handles 103 to a desired position via the handle adjustment apertures 105 and handle adjustment pins 107; installing the monkey arm covers 67 onto the handle 103 and securing the arm cover elastic portions 68 over the handle grooves 108; rotating the ground support 27 to the downward position to engage the area between the couch back portion 140 and couch seat portion 141; placing the apparatus 10 on the couch with each handle 103 suspended from the couch back portion 140; placing the infant inside the apparatus 10 on the seat 40; adjusting the harness 30 to snuggly fit the infant and buckling the harness 30; attaching the toy bar 50; placing the power switch 80 and operational switch 81 into a desired position; removing the monkey head 60, legs covers 65, and monkey arm covers 67 for cleaning and adjusting; and, allowing the infant to play in the secure apparatus 10.

The method of utilizing the apparatus 10 on a ground or level surface is similar to the abovementioned procedure, yet with the addition of swiveling the ground support 27 to the downward position.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An infant chair with an animal motif, comprising:

a chair, said chair comprising a resilient frame and a seat supported on said frame, a head attachment portion; and a restraint means for restraining an infant occupant therein said seat;

said animal motif comprising a plurality of decorative elements removably attachable to said frame;

a plurality of toys removably suspended from said chair; and, an electronic entertainment system attached to said chair;

wherein said frame further comprises:

a pair of tubular inclined members angling upwardly and extending horizontally and rearwardly to engage a ground surface, each comprising a lower portion and an upper portion;

a pair of adjustable legs each removably affixed to each terminal end of said lower portion of one of said pair of inclined members with a leg attachment means;

a pair of adjustable handles each removably affixed to each terminal end of said upper portion of one of said pair of inclined members with a handle attachment means;

a rear support brace horizontally attached to and spanning a width between said lower portions of each of said pair of inclined members;

a front support brace horizontally attached to and spanning a width between said lower portions of each of said pair of inclined members fore of said rear support brace; and, a head attachment portion horizontally attached to and spanning a width between said upper portions of each of said pair of inclined members;

wherein said pair of inclined members can engage a ground surface when rested thereupon;

wherein said pair of legs provides a selectable length adjustment with respect to said lower portion of said pair of inclined members;

wherein said pair of handles provides a selectable length adjustment with respect to said upper portion of said pair of inclined members;

wherein said pair of handles engage an upper surface of said support structure and support said infant chair when rested thereupon;

wherein said infant chair supports and protects an infant occupant therein; and, wherein said infant chair is supported by a support structure.

2. The infant chair of claim 1, wherein said leg attachment means further comprises:

a plurality of leg adjustment apertures equidistantly spaced along a distal surface of one of said pair of legs; and, an adjustment pin located on said lower portion of one of said pair of inclined members correspondingly mating with one of said plurality of leg adjustment apertures.

3. The infant chair of claim 2, wherein said plurality of toys are suspended from a toy bar removably attached to and spanning a width between a first toy bar attachment and a second toy bar attachment;

wherein said first toy bar attachment and said second toy bar attachment are affixed to opposing locations of said upper portion of said pair of inclined members adjacent to said seat; and, wherein said plurality of toys further comprise said animal motif.

4. The infant chair of claim 3, wherein said electronic entertainment system further comprises a vibrating means mounted within either one of said first toy bar attachment or said second toy bar attachment second toy bar attachment, a power supply, a switch providing electrical communication between said power supply and said vibrating means, a variable speed control switch in electrical communication with said vibrating means.

5. The infant chair of claim 4, wherein said vibrating means further comprises a motor, a drive shaft driven by said motor, an offset mass connected to said drive shaft.

6. The infant chair of claim 2, further comprising:

a pair of leg covers each having an elastic portion located at a distal end thereof removably attachable and retained within a groove located on one of said pair of legs;

a pair of handle covers each having an elastic portion located at a distal end thereof removably attachable and retained within a groove located on one of said pair of handles; and, a head attachment, comprising a head body with a fastener located on a rear surface thereof for removable attachment to a corresponding fastener on said head attachment portion;

wherein said pair of leg covers, said pair of handle covers, and said head attachment all correspond to said animal motif.

7. The infant chair of claim 6, wherein said pair of leg covers, said pair of handle covers, and said head attachment further comprise a soft and comfortable material.

8. The infant chair of claim 7, wherein said animal motif is one of the following: a monkey, an elephant, a bear, or a frog.

9. The infant chair of claim 2, further comprising a ground support rotatably attached via a ground support attachment means to one of said pair of legs, further comprising an "L"-shaped form with a decorative element corresponding to said animal motif;

wherein said ground support provides additional stability to said infant chair when placed on said ground surface.

10. The infant chair of claim 9, wherein said ground support attachment means further comprises a groove disposed along an outer circumference of said ground support correspondingly mating with a slot disposed along an inner circumference of one of said pair of legs.

11. The infant chair of claim 1, wherein each of said pair of handles further comprises an integral flattened handle portion on a proximal end which provides a flattened surface to engage a rear portion of said support structure.

12. The infant chair of claim 1, wherein said handle attachment means further comprises:

a plurality of handle adjustment apertures equidistantly spaced along a distal surface of one of said pair of handles; and, an adjustment pin located on said upper portion of one of said pair of inclined members correspondingly mating with one of said plurality of handle adjustment apertures.

13. The infant chair of claim 1, wherein said seat is affixed to said upper portion of said pair of inclined members and further comprises:

said head attachment portion spanning a width of said upper portion of said pair of inclined members above said seat; and, said restraint means further comprising an adjustable harness affixed to said seat.

14. An infant chair with an animal motif, comprising:

a chair, said chair comprising:

a resilient frame, further comprising:

a pair of tubular inclined members angling upwardly and extending horizontally and rearwardly to engage a ground surface, each comprising a lower portion and an upper portion;

a pair of adjustable legs each removably affixed to each terminal end of said lower portion of one of said pair of inclined members with a leg attachment means;

a pair of adjustable handles each removably affixed to each terminal end of said upper portion of one of said pair of inclined members with a handle attachment means;

a rear support brace horizontally attached to and spanning a width between said lower portions of each of said pair of inclined members; and, a front support brace horizontally attached to and spanning a width between said lower portions of each of said pair of inclined members fore of said rear support brace;

a seat affixed to said upper portion of said pair of inclined members and further comprises:

a head attachment portion horizontally attached to and spanning a width of said upper portion of said pair of inclined members above said seat; and, a restraint means further comprising an adjustable harness affixed to said seat;

a toy bar removably attached to and spanning a width between a first toy bar attachment and a second toy bar attachment, wherein said first toy bar attachment and said second toy bar attachment are affixed to opposing locations of said upper portion of said pair of inclined members adjacent to said seat;

a plurality of toys removably suspended from said toy bar;

a vibrating means mounted within said second toy bar attachment second toy bar attachment, further comprising:

a power supply;

a motor, a drive shaft driven by said motor, an offset mass connected to said drive shaft;

a switch providing electrical communication between said power supply and said motor; and, a variable speed control switch in electrical communication with said motor; and, an animal motif, comprising a plurality of covers attachable to said chair, further comprising:

a pair of leg covers each having an elastic portion located at a distal end thereof removably attachable and retained within a groove located on one of said pair of legs;

a pair of handle covers each having an elastic portion located at a distal end thereof removably attachable and retained within a groove located on one of said pair of handles; and, a head attachment, comprising a head body with a fastener located on a rear surface thereof for removable attachment to a corresponding fastener on said head attachment portion;

wherein said infant chair supports and protects an infant occupant therein;

wherein said pair of inclined members can engage a ground surface when rested thereupon;

wherein said pair of legs provides a selectable length adjustment with respect to said lower portion of said pair of inclined members;

wherein said pair of handles provides a selectable length adjustment with respect to said upper portion of said pair of inclined members; and, wherein said pair of handles engage an upper surface of said support structure and support said infant chair when rested thereupon.

15. The infant chair of claim 14, wherein said leg attachment means further comprises:

a plurality of leg adjustment apertures equidistantly spaced along a distal surface of one of said pair of legs; and, an adjustment pin located on said lower portion of one of said pair of inclined members correspondingly mating with one of said plurality of leg adjustment apertures.

16. The infant chair of claim 14, wherein said handle attachment means further comprises:

a plurality of handle adjustment apertures equidistantly spaced along a distal surface of one of said pair of handles; and, an adjustment pin located on said upper portion of one of said pair of inclined members correspondingly mating with one of said plurality of handle adjustment apertures.

17. The infant chair of claim 14, further comprising a ground support rotatably attached via a ground support attachment means to one of said pair of legs, further comprising an "L"-shaped form with a decorative element corresponding to said animal motif;

wherein said ground support provides additional stability to said infant chair when placed on said ground surface; and, wherein said ground support attachment means further comprises a groove disposed along an outer circumference of said ground support correspondingly mating with a slot disposed along an inner circumference of one of said pair of legs.

18. The infant chair of claim 17, wherein said pair of leg covers, said pair of handle covers, and said head attachment further comprise a soft and comfortable material.

19. The infant chair of claim 18, wherein said animal motif is one of the following: a monkey, an elephant, a bear, or a frog.

* * * * *